US007861888B2

(12) United States Patent
Niedzwiecki

(10) Patent No.: US 7,861,888 B2
(45) Date of Patent: Jan. 4, 2011

(54) STACKABLE STEMWARE

(75) Inventor: Scott Niedzwiecki, Sugar Grove, IL (US)

(73) Assignee: Solo Cup Operating Corporation, Highland Park, IL (US)

( * ) Notice: Subject to any disclaimer, the term of this patent is extended or adjusted under 35 U.S.C. 154(b) by 762 days.

(21) Appl. No.: 11/553,024

(22) Filed: Oct. 26, 2006

(65) Prior Publication Data

US 2008/0099364 A1 May 1, 2008

(51) Int. Cl.
*B65D 21/00* (2006.01)
*B65D 85/62* (2006.01)

(52) U.S. Cl. ..... 220/703; 220/630; 206/499; 206/504; 206/519; 206/520; 215/10

(58) Field of Classification Search ..... 220/630, 220/703; 206/499, 504, 509, 517, 519, 520; 215/10, 377; D7/509, 537
See application file for complete search history.

(56) References Cited

U.S. PATENT DOCUMENTS

| | | | | |
|---|---|---|---|---|
| 83,341 | A | | 10/1868 | Towndrow |
| 600,427 | A | | 3/1898 | Jones, Jr. |
| 809,567 | A | | 1/1906 | Henckel |
| 2,169,426 | A | | 8/1939 | Morton |
| 2,585,445 | A | | 10/1948 | Dingeldein |
| 2,918,188 | A | | 3/1957 | Todd |
| 2,996,208 | A | | 3/1960 | Schroeder |
| 3,079,037 | A | | 2/1963 | Schechter |
| 3,089,605 | A | | 5/1963 | Buonauro |
| 3,091,360 | A | | 5/1963 | Edwards |
| 3,325,048 | A | | 6/1967 | Edwards |
| 3,347,411 | A | | 10/1967 | Kalata et al. |
| 3,369,687 | A | | 2/1968 | Walls |
| 3,441,173 | A | * | 4/1969 | Edwards ..... 206/520 |
| 3,482,731 | A | | 12/1969 | Douty |
| 3,526,335 | A | | 9/1970 | Swett et al. |
| 3,784,052 | A | | 1/1974 | Edwards |
| 3,934,725 | A | | 1/1976 | Edwards |
| 3,987,930 | A | | 10/1976 | Fuson |
| 5,014,865 | A | * | 5/1991 | Sauber ..... 215/377 |
| 5,146,957 | A | | 9/1992 | Belokin, Jr. et al. |
| 5,160,031 | A | * | 11/1992 | Palisin et al. ..... 206/519 |
| 5,513,764 | A | | 5/1996 | Harrison et al. |
| 5,763,030 | A | | 6/1998 | Matsui |
| 5,842,590 | A | | 12/1998 | Gordon et al. |
| 5,996,825 | A | * | 12/1999 | Gordon et al. ..... 215/10 |
| 6,164,473 | A | * | 12/2000 | Waldrip ..... 215/378 |
| 6,213,301 | B1 | | 4/2001 | Landis et al. |
| 6,409,374 | B1 | | 6/2002 | Willat |
| D474,648 | S | | 5/2003 | Dimeo |
| 6,640,989 | B2 | * | 11/2003 | Matsui ..... 215/377 |

(Continued)

FOREIGN PATENT DOCUMENTS

| | | |
|---|---|---|
| CA | 961785 | 1/1975 |

(Continued)

*Primary Examiner*—Anthony Stashick
*Assistant Examiner*—Madison L Wright
(74) *Attorney, Agent, or Firm*—Hanley, Flight & Zimmerman, LLC

(57) ABSTRACT

Stackable stemware provides nestably stackable respective upper and lower portions wherein the lower portions include at least one reinforcing rib to limit the stacking depth of similar lower portions when nestably stacked.

20 Claims, 3 Drawing Sheets

U.S. PATENT DOCUMENTS

| | | | | |
|---|---|---|---|---|
| 6,644,846 | B2 | 11/2003 | Willat | |
| D509,993 | S | 9/2005 | Lambert et al. | |
| D514,387 | S | 2/2006 | Rockwell, Jr. | |
| 2003/0098311 | A1* | 5/2003 | Parentini | 220/630 |

FOREIGN PATENT DOCUMENTS

| | | |
|---|---|---|
| EP | 0012009 | 6/1980 |
| FR | 1236001 | 10/2006 |
| JP | 2282051 | 11/1990 |

* cited by examiner

STACKABLE STEMWARE

FIELD OF THE DISCLOSURE

The disclosure relates generally to disposable plastic glasses formed by connecting an upper portion and a lower portion and, more particularly, to multi-piece stemware that permits nestable stacking of a respective series of similar upper portions as well as a respective series of lower portions.

BACKGROUND

It is quite common for stemware to be used to serve beverages or food products such as desserts. Often, it is desirable to use stemware of particular shapes to serve different types of drinks or food products. However, it can be costly and inconvenient to use conventional one-piece crystal, glass or porcelain stemware for certain occasions.

Accordingly, there have been developed a number of disposable types of stemware, typically made of plastic. For convenience of shipping and packaging, some disposable stemware products have been developed utilizing a two-piece construction. Such two-piece constructions typically include an upper portion and a lower portion, where the upper portion is joined to the lower portion to form a complete drinking glass or container. It is common for a series of the upper portions to be nestably stackable, as well as for a series of lower portions to be nestably stackable. As such, the disassembled two-piece stemware may be more easily produced and more compactly packaged and shipped than if each glass were of unitary construction.

Unfortunately, some two-piece plastic stemware constructions that have a lower portion with a broadened base and an upwardly extending stem tend to have upper or lower portions that bind when those respective portions are nestably stacked. Also, known plastic stemware constructions tend to have a base which contacts an underlying surface, such as a table top, over very little surface area. That limited surface area is generally concentrated at a peripheral lower edge. This can lead to instability, if the glass is inadvertently placed, for instance, slightly over an edge of a table. In addition, while potentially acceptably rigid, the bases of prior art plastic stemware also tend to have no additional support in the region where the broadened base transitions into the upward extending stem.

It should be understood that the drawings are not necessarily to scale. While other plan and section views are not included, the details such views would show are considered to be adequately shown in the present views or well within the comprehension of those skilled in the art in light of the present disclosure. It also should be understood that the present invention is not limited to the examples illustrated.

DETAILED DESCRIPTION

It would be desirable to provide an improved multi-piece plastic stemware product that has an upper portion that may be quickly and easily assembled to a lower portion, and for each of a series of the upper portions and a series of the lower portions, respectively, to be nestably stackable, while preventing binding between like pieces. It further would be desirable to have a base with contact area within a lowest most contact plane, in addition to that contact area which is provided at the outer peripheral rim of the base. It also may be advantageous to have a base having the lower portion reinforced in the region of the transition from a broadened base to an upward extending stem portion.

Referring generally to FIGS. 1-6, it will be appreciated that the multi-piece stackable stemware of the present invention may be embodied within numerous configurations, some examples of which are shown.

The examples disclosed present alternatives to known disposable stemware products that have lower portions that may tend to bind when stacked, that rely on contact with only a peripheral rim for stability, or that are not reinforced in the region of transition from the base to the stem. The examples provide for relatively simple manufacturing of plastic stemware components by permitting the construction to be in two separate pieces. They also provide for intuitive, simple connection of an upper portion to a lower portion to form a completed disposable stackable stemware product.

The examples provide nestably stackable respective upper and lower portions wherein the lower portions include a shoulder or ledge and include one or more ribs that limit the stacking depth of similar lower portions when nestably stacked, thereby preventing binding of like lower portions, and where the at least one rib increases the contact area of the base with an underlying surface. While the ledge is shown at a substantially normal or right angle to the stem in the examples, it will be appreciated that other angles may be used. The one or more ribs also can be configured to provide reinforcement in the region of transition from the base to the stem. In the examples shown, the upper portions are configured to have the sidewalls of respective upper portions contact each other when stacked. However, it will be appreciated that the respective sidewalls need not contact each other.

Figure 1B:
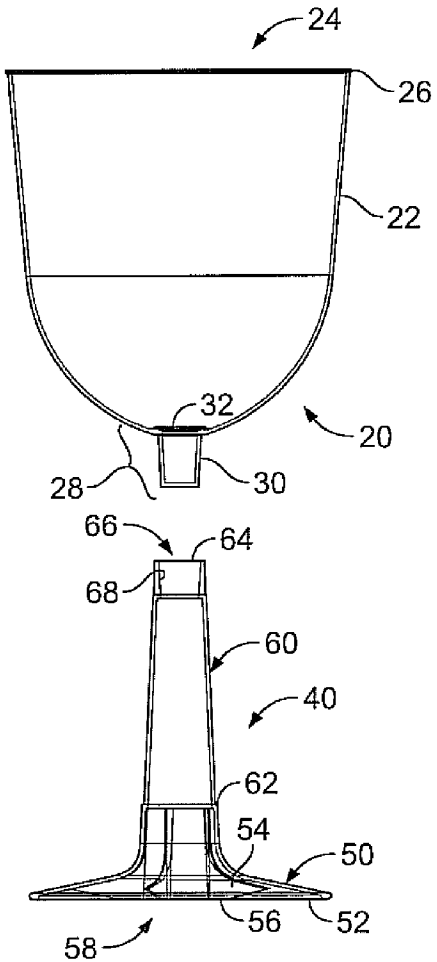
FIG. 1*b* is a front view of the unassembled pieces of the example shown in FIGS. 1 and 1*a*.
Figure 1A:
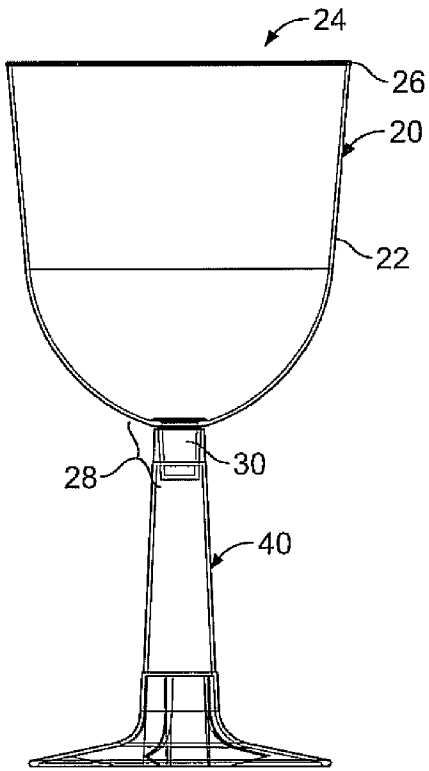
FIG. 1*a* is a front view of the assembled example shown in FIG. 1.
Figure 1:
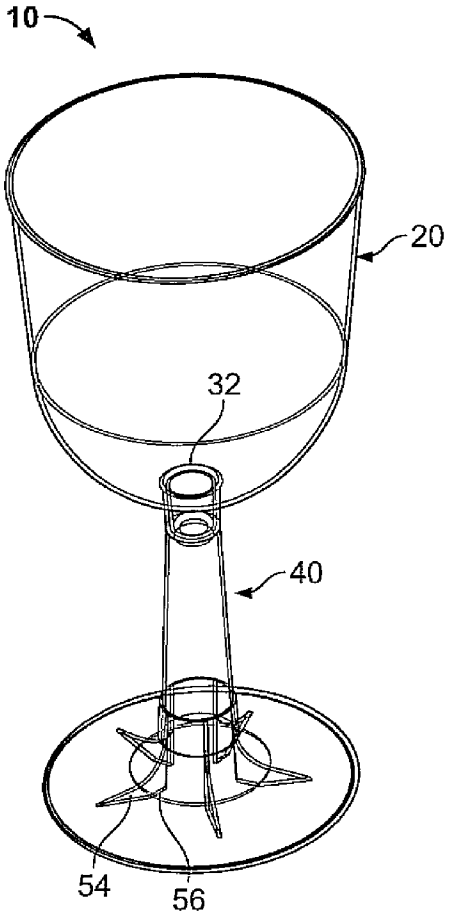
FIG. 1 is a perspective view of an example of a multi-piece stemware assembly.
Figure 2:
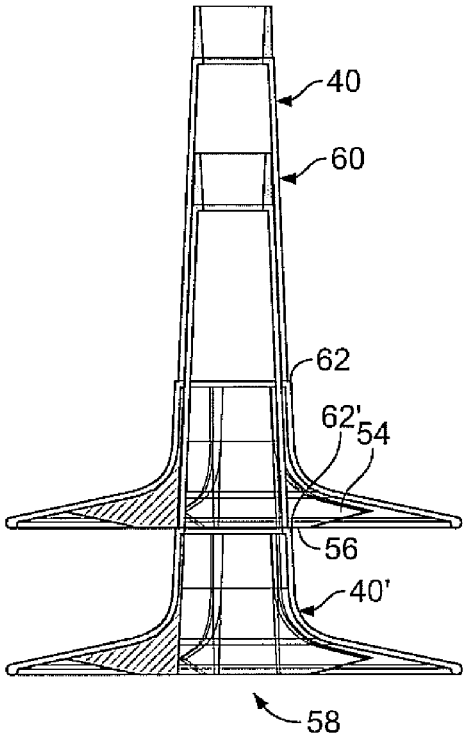
FIG. 2 is a cross-sectional view of a pair of nestably stacked lower portions of a multi-piece stemware assembly consistent with the lower portion of the example shown in FIG. 1.
Figure 3:
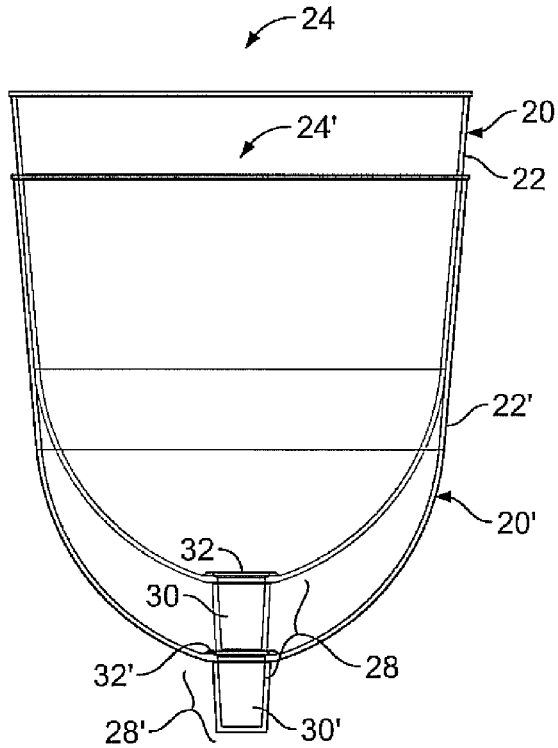
FIG. 3 is a front view of a pair of nestably stacked upper portions of a multi-piece stemware assembly consistent with the upper portion of the example shown in FIG. 1.

Referring to the example in FIGS. 1-3, a multi-piece stemware container 10, generally in the shape of a wine glass, has an upper portion 20 and a lower portion 40. The upper portion 20 and the lower portion 40 may be of molded plastic construction, utilizing materials and molding methods that are common within the art, and preferably includes injection molding of polystyrene.

As best seen in FIG. 1*b*, the upper portion 20 has a sidewall 22 that forms a cavity 24 that is open at a top 26 of the upper portion 20 and closed at a bottom 28 of the upper portion. The bottom 28 of the upper portion 20 includes an integrally formed plug 30 extending downwardly. The plug 30 is preferably tapered to have a larger outer diameter at its open upper end than the outer diameter at its closed lower end, although alternative configurations may be employed.

Also as best seen in FIG. 1*b*, the lower portion 40 includes a base 50 and an upwardly extending stem 60. The base 50 extends radially outward to a peripheral lower edge 52. The lower portion 40 also includes internal vertical ribs 54, which are circumferentially spaced apart. In this example, the ribs 54 are integrally formed on the inside of the lower portion 40 and are connected along the transition region from the base 50 at least partially into the stem 60 to provide reinforcement to this region. However, the ribs 54 need not be connected to both the base 50 and the stem 60. While there are five ribs 54 shown in this example, it will be appreciated that fewer or more ribs may be used. Each of the ribs 54 has a lower edge 56, at least a portion of which is substantially coplanar with the peripheral lower edge 52 of the base 50. The added coplanar contact area provided by at least a portion of lower edges 56 of the ribs 54 may enhance the stability of stemware 10 in instances where the peripheral lower edge 52 of the base 50 is not otherwise fully supported by an underlying surface.

The stem 60 extends upwardly from the base 50 and includes a shoulder or outer ledge 62 formed around the stem 60. Thus, the shoulder or outer ledge 62 is integrally formed in a position on the stem 60 located above the base 50. The outer ledge 62 also preferably presents a contact surface in a plane substantially normal to the outer surface of the stem 60. However, it will be appreciated that the outer ledge may be configured to be at a different angle. The stem 60 also has at its upper end 64 an aperture 66. The aperture 66 receives the plug 30 and has a tapered profile along an inner wall 68, which is configured to provide a relatively snug fit (e.g., a press fit, an interference fit, etc.) for the plug 30. The snug, press fit of the plug 30 within the stem 60 enables the upper portion 20 and the lower portion 40 to be connected or coupled for use as stemware. Thus, the corresponding press fit components shown would form a removably connected assembly, as seen in FIGS. 1 and 1*a*. However, alternative connection profiles could be employed to provide a connection between the upper and lower portions. For example, a threaded or rotatable locking connection or coupling may be used. Alternatively, a more permanent connection, such as using snap fit locking components, may be used.

Figure 2A:
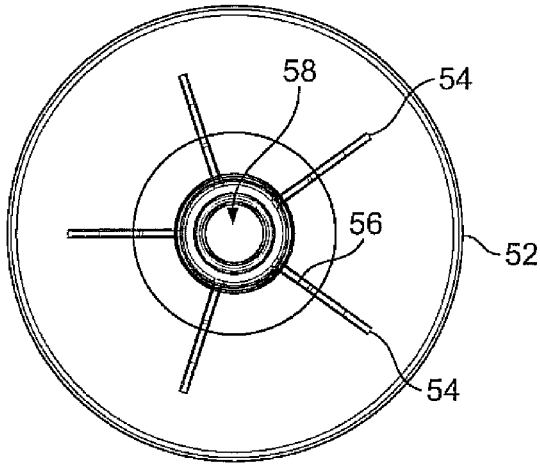
FIG. 2*a* is a top view of one of the lower portions of the example shown in FIG. 2.

Turning to FIGS. 2 and 2*a*, similar lower portions 40 may be nestably stacked for more compact packaging or shipment. The ribs 54 are configured to circumscribe a central opening 58 through the lower portion 40. The central opening 58 corresponds to or is slightly larger than the outer diameter of the stem 60 just above the shoulder or outer ledge 62 and is smaller than the outer diameter of the stem 60 at the outer ledge 62. This configuration enables a portion of the lower edges 56 of the ribs 54 of the first lower portion 40 to stop against or rest on top of an outer ledge 62' of a similar, second lower portion 40' when nestably stacked. Thus, the respective ribs 54 and outer ledges 62 of successive lower portions 40 serve as mechanical stops or stacking limiters that allow a plurality of lower portions 40 to be nestably stacked, while preventing the binding between respective lower portions 40 that would otherwise occur if stems 60 were permitted to fully contact each other along their tapered lengths.

The upper portions 20 also may be nestably stacked for more compact packaging or shipment, as illustrated in FIG. 3. The tendency of bowl or cup-shaped items to become press fit or vapor-locked together is avoided when the plug 30 of a first upper portion is received in cavity 24' of a similar second upper portion 20' and rests upon the inner surface of bottom 28'. The closed lower end of plug 30 does not extend downward into the open upper end of the plug 30' because the outer diameter of the closed lower end of the plug 30 is larger than the inner diameter of the open upper end of the similar plug 30'. An optional raised lip 32, 32' is located around the open upper end of plug 30, 30' to help center the plug 30 as it is received in the cavity 24' when nestably stacked. Also, like sidewalls 22, 22' contact each other when nestably stacked, further tending to center respective upper portions. Thus, the length of the plug 30 and the shape and angle of sidewall 22 may be configured to limit the travel of the upper portion 20 into the second upper portion 20', to enable nestable stacking, while reducing the effort required to separate like components.

Figure 4:
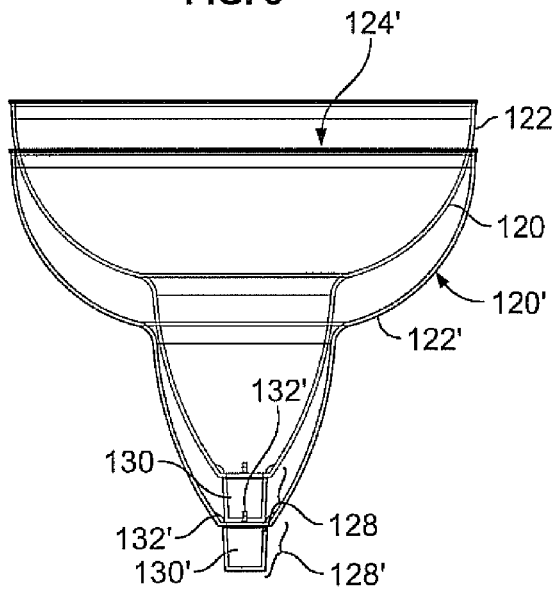
FIG. 4 is a front view of a pair of nestably stacked upper portions of a multi-piece stemware assembly having an example of a first alternative side wall shape.

Referring now to FIG. 4, first alternatively shaped upper portions 120 and 120' are shown, generally providing the shape of margarita glasses. In this example a plug 130 of the first upper portion 120 is received in a cavity 124' of a similar second upper portion 120' and rests upon the inner surface of the bottom 128' at the open upper end of the plug 130'. Once again, the length of the plug 130 and the shape and angle of the sidewall 122 may be configured to limit the travel and prevent binding of like components. The example shown in FIG. 4 also includes optional tabs 132' located around the inner surface of the bottoms 128, 128' at the open upper end of the plugs, 130, 130'. Tabs 132' circumscribe an area for the plug 130 to facilitate the centering of the plug 130 when nestably stacking like upper portions. Centering also is assisted by sidewalls 122, 122' contacting each other when like upper portions are stacked.

Figure 5:
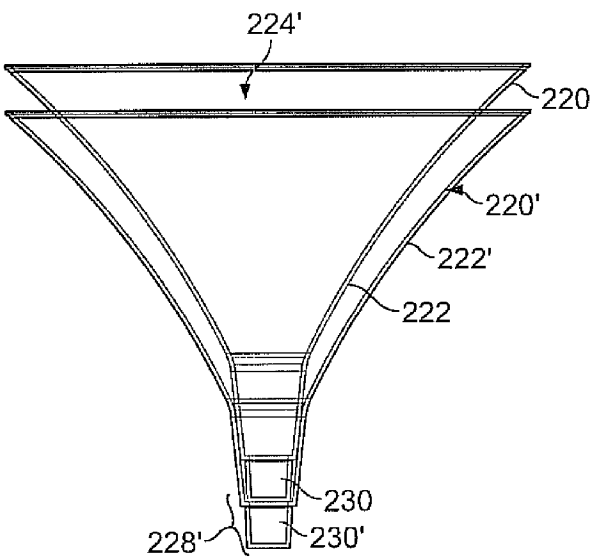
FIG. 5 is a front view of a pair of nestably stacked upper portions of a multi-piece stemware assembly having an example of a second alternative side wall shape.

Turning to FIG. 5, second alternatively shaped upper portions 220 and 220' are shown, generally providing the shape of martini glasses. Here, a sidewall 222 has a first fairly tapered lower region and then a more flared upper region. In this example, a plug 230 of the first upper portion 220 is received in a cavity 224' of a similar second upper portion 220' and rests upon the inner surface of the bottom 228' at the open upper end of the plug 230'. The length of the plug 230 and the shape and angle of the regions of sidewall 222 may be configured to limit the travel and prevent binding of like components. In this example, the sidewall 222 contacts the like sidewall 222' in their respective tapered regions. This assists in centering, without need for tabs along the bottom 228', while the plug 230 still limits travel in a manner to prevent binding between like upper portions.

Figure 6:
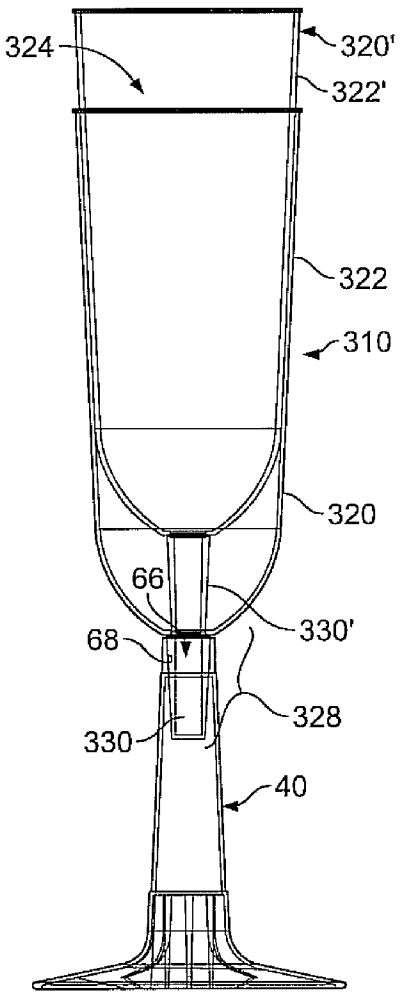
FIG. 6 is a front view of a pair of nestably stacked upper portions of a multi-piece stemware assembly having an example of a third alternative side wall shape, and with the lowermost upper portion being assembled to a lower portion such as that shown in FIGS. 1 and 2.

In FIG. 6, a multi-piece stemware container 310, generally in the shape of a champagne glass, has a third alternatively shaped upper portion 320 and a common lower portion 40, and is shown with another upper portion 320' in a nestably stacked position. As clearly seen, the length of a plug 330' has been extended in this example, to account for the alternative shape and draft angle of sidewall 322, 322'. Nevertheless, similar plug 330 is received by the aperture 66 for a common press fit connection with the tapered wall 68 of the lower portion 40. Thus, when the plug 330' is received in cavity 324 and rests on the inner surface of the bottom 328 at the open upper end of the plug 330, like upper portions 320 and 320' are prevented from binding as would occur if they were permitted to achieve a tight press fit connection with each other. Depending on the shape and breadth of the broader area of the bottom 328 around the open upper end of the plug 330, an optional raised lip or tabs may be used to assist in centering the plug 330' when nestably stacking the like upper portions, such as are shown in FIGS. 1 and 1*b* as the raised lip 32 and in FIG. 4 as the tabs 132', respectively.

The stackable stemware examples disclosed herein provide upper and lower portions of stemware that are prevented from binding when respective similar portions are nestably stacked. The lower portions utilize one or more ribs that serve to limit the stacking depth of similar lower portions and increase the contact area of the base with respect to an underlying surface. Each rib also may be configured to provide reinforcement in the transition region of the lower portion from the base to the upwardly extending stem. The upper portions utilize a downwardly projecting plug for connection to the lower portion and to limit the stacking depth when nestably stacking like upper portions.

It will be appreciated that a multi-piece stemware article in accordance with the present invention may be provided in various configurations. Any variety of suitable materials of construction, configurations, shapes and sizes for the components and methods of connecting the components may be utilized to meet the particular needs and requirements of an application. It will be apparent to those skilled in the art that various modifications can be made in the design and construction of such stemware without departing from the scope or spirit of the present invention, and that the claims are not limited to the illustrated examples. On the contrary, this patent covers all methods, apparatus and articles of manufacture fairly falling within the scope of the appended claims either literally or under the doctrine of equivalents.

What is claimed is:

1. A multi-piece stemware container comprising:

an upper portion having an upwardly opening cavity;

a lower portion further comprising a base with an upwardly extending stem configured to be connected to the upper portion;

the stem further comprising an outer ledge disposed above the base; and the base further comprising at least one rib, wherein the at least one rib contacts the outer ledge on a similar lower portion when nestably stacked on the similar lower portion, and wherein the rib extends along a transition region from the base at least partially into the stem, wherein the transition region is a change in an exterior surface between the base and the stem.

2. A stemware container as defined in claim 1, wherein the upper portion is nestably stackable within a similar second upper portion.

3. A stemware container as defined in claim 1, wherein the at least one rib further comprises a plurality of ribs with each rib having a lower edge and the ribs circumscribing a central opening through the base.

4. A stemware container as defined in claim 1, wherein the at least one rib has a lower edge and at least a portion of the lower edge contacts the outer ledge on the similar lower portion when nestably stacked on the similar lower portion.

5. A stemware container as defined in claim 1, wherein the upper portion is removably connectable to the lower portion.

6. A stemware container as defined in claim 1, wherein the upper portion further comprises a downwardly projecting plug and the plug of the upper portion is received within a cavity of a similar second upper portion when the upper portion is nestably stacked with the second upper portion.

7. A stemware container as defined in claim 6, wherein the stem further comprises an upper end having an aperture to receive the plug of the upper portion.

8. A stemware container as defined in claim 6, wherein the plug is tapered to have a larger outer diameter at an upper end of the plug relative to an outer diameter at a lower end of the plug.

9. A stemware container as defined in claim 1, wherein the lower portion is connectable to each of a plurality of differently shaped upper portions.

10. A multi-piece stemware container comprising:

an upper portion having an upwardly opening cavity;

a lower portion further comprising a base with an upwardly extending stem configured to be connected to the upper portion;

the stem further comprising an outer ledge disposed above the base; and the base further comprising at least one rib, wherein the at least one rib contacts the outer ledge on a similar lower portion when nestably stacked on the similar lower portion, wherein the rib extends along a transition region from the base at least partially into the stem, and wherein the base further comprises a lower peripheral edge in a first plane and wherein at least a portion of a lower edge of the at least one rib is substantially coplanar with the lower peripheral edge of the base.

11. A multi-piece stemware container comprising:

an upper portion having an upward opening cavity and a downward projecting plug;

a lower portion further comprising a base having a first diameter and an upward extending stem having a second diameter different than the first diameter and the lower portion having an aperture configured to receive the plug;

the stem further comprising an outer ledge disposed above the base;

the base further comprising at least one rib having a lower edge, the at least one rib configured to permit a central opening through the base, wherein the lower edge on the at least one rib contacts the outer ledge on a similar lower portion when nestably stacked on the similar lower portion, and wherein the rib extends between the first diameter and the second diameter; and the upper portion further comprising one or more tabs located at an inner surface of the cavity at an upper end of the plug.

12. A stemware container as defined in claim 11, wherein the upper portion is removably connectable to the lower portion.

13. A stemware container as defined in claim 11, wherein the at least one rib further comprises a plurality of ribs with each rib having a lower edge and the ribs circumscribing a central opening through the base.

14. A stemware container as defined in claim 11, wherein a first upper portion is nestably stackable within a similar second upper portion.

15. A stemware container as defined in claim 11, wherein the lower portion is connectable to each of a plurality of differently shaped upper portions.

16. A multi-piece stemware container comprising:

an upper portion having an upward opening cavity and a downward projecting plug;

a lower portion further comprising a base with an upward extending stem having an aperture configured to receive the plug;

the stem further comprising an outer ledge disposed above the base;

the base further comprising at least one rib having a lower edge, the at least one rib configured to permit a central opening through the base, wherein the lower edge on the at least one rib contacts the outer ledge on a similar lower portion when nestably stacked on the similar lower portion; and the upper portion further comprising one or more tabs located at an inner surface of the cavity at an upper end of the plug, wherein the base further comprises a lower peripheral edge in a first plane and wherein at least a portion of the lower edge of the at least one rib is substantially coplanar with the lower peripheral edge of the base.

17. A lower stemware portion comprising:

a base with an upwardly extending stem;

the stem further compromising an outer ledge disposed above the base and having an aperture at an upper end;

the base further comprising at least one rib, wherein the at least one rib contacts the outer ledge on a similar lower stemware portion when nestably stacked on the similar lower portion, and wherein a portion of at least one rib supports at least a portion of the lower stemware portion on an underlying surface, wherein the base further comprises a lower peripheral edge in a first plane, and wherein the at least one rib has a lower edge with at least a portion of the lower edge being substantially coplanar with the lower peripheral edge of the base.

18. A lower stemware portion as defined in claim 17, wherein the lower stemware portion is connectable to an upper stemware portion.

19. A lower stemware portion as defined in claim 17, wherein the at least one rib further comprises a plurality of ribs with each rib having a lower edge and the ribs circumscribing a central opening through the base.

20. A lower stemware portion as defined in claim 19, wherein at least a portion of the lower edge of each rib contacts the outer ledge on the similar lower portion when nestably stacked on the similar portion.

* * * * *